US005268703A

United States Patent [19]

Wingard

[11] Patent Number: 5,268,703

[45] Date of Patent: Dec. 7, 1993

[54] DECORATIVE ANTENNA

[76] Inventor: Jefferson C. Wingard, 1022 Lady's La., Anderson, S.C. 29621

[21] Appl. No.: 848,928

[22] Filed: Mar. 10, 1992

[51] Int. Cl.[5] ..... H01Q 011/08; H01Q 001/00

[52] U.S. Cl. ..... 343/895

[58] Field of Search ..... 343/720, 895, 894; D14/230, 234

[56] References Cited

U.S. PATENT DOCUMENTS

| | | | |
|---|---|---|---|
| 2,420,772 | 5/1947 | Dalton | 343/715 |
| 4,097,867 | 6/1978 | Eroncie | 343/895 |
| 4,137,534 | 1/1979 | Goodnight | 343/895 |
| 4,214,247 | 7/1980 | Richmond | 343/895 |

*Primary Examiner*—Rolf Hille
*Assistant Examiner*—Peter Toby Brown
*Attorney, Agent, or Firm*—Cort Flint

[57] ABSTRACT

A decorative pole antenna and method is disclosed which includes an elongated, dielectric core which is wrapped with a decorative, "Christmas paper" like film having a well defined reflective pattern. An attachment ferrule is attached to one end of the core and a tuning coil includes space winding wrapped over the decorative film terminating at adjacent windings at the second end of the core. A transparent film is then shrunk over the entire assembly whereby the decorative film imparts a highly visible reflective pattern to the antenna in use without affecting the electrical characteristics of the antenna.

10 Claims, 2 Drawing Sheets

DECORATIVE ANTENNA

BACKGROUND OF THE INVENTION

The invention relates to a decorative antenna, and particularly, to a decorative pole antenna for use on vehicles and the like having a Christmas paper like decorative appearance.

The use of two-way radio and telephone communications in vehicles has become increasingly popular on a wide range of vehicles. In response to this increasing popularity, there has been an increase in need for antennas to complement the use on various vehicles. Consumers are increasingly desiring that antennas be provided having more than just an ordinary hardware appearance. For example, it has been known in the case of citizen band radio antennas to provide a dielectric core which is wrapped with a conductive wire over which a clear shrink film is applied. The core has been provided in colors of black and white. The result is a colored antenna, but not a decorative antenna.

Accordingly, an object of the invention is to provide a decorative antenna construction and method whereby pole antennas may be provided with various decorative patterns in an extremely pleasing, but functional manner.

Another object of the invention is to provide decorative antennas having a patterned decorative appearance without adversely affecting the performance of the antenna or its structure.

SUMMARY OF THE INVENTION

The above objectives are accomplished according to the present invention by providing a decorative antenna which includes an elongated fiberglass core for flexibility. The fiberglass core is laminated with a decorative, patterned, non-conductive film over an exposed length of the core, and the non-conductive film has a well defined pattern on an exterior side. A conductive coil is wrapped around the non-conductive film substrate and is terminated at a free end of the antenna in a tuned coil. A transparent film is shrunk over the total assembly through which the patterned decorative film is highly visible. By selecting a patterned, plasticized (i.e., containing or made of plastic) film, the decorative pattern is highly reflective and visible through the protective shrink film outer-layer. The non-conductive film decorative substrate does not affect the performance characteristics of the antenna.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF PREFERRED EMBODIMENT

Figures 1, 2:
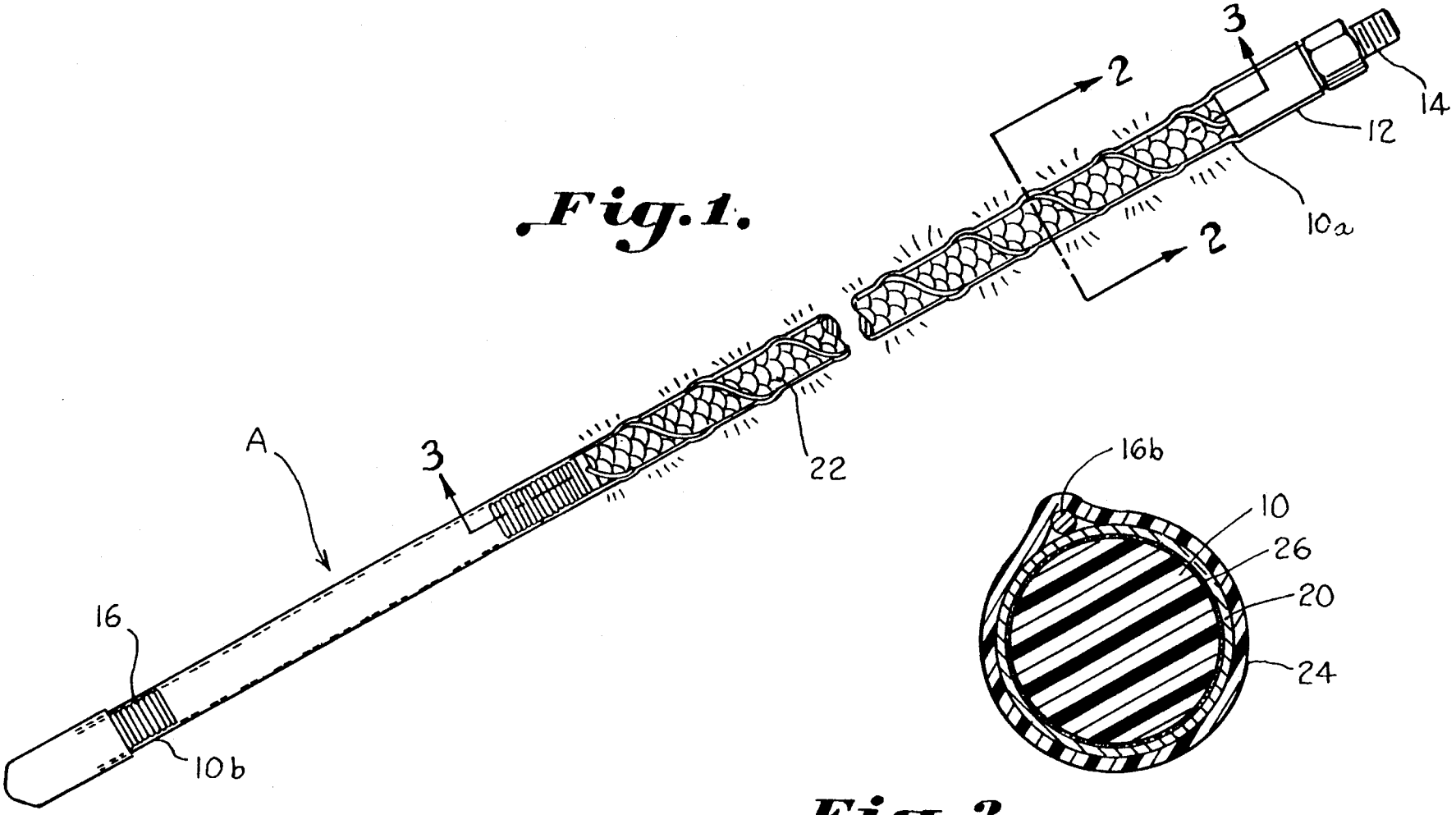
FIG. 1 is an elevation illustrating a decorative pole antenna constructed according to the present invention and method.
FIG. 2 is section of view taken along line 2—2 of FIG. 1.
Figure 3:
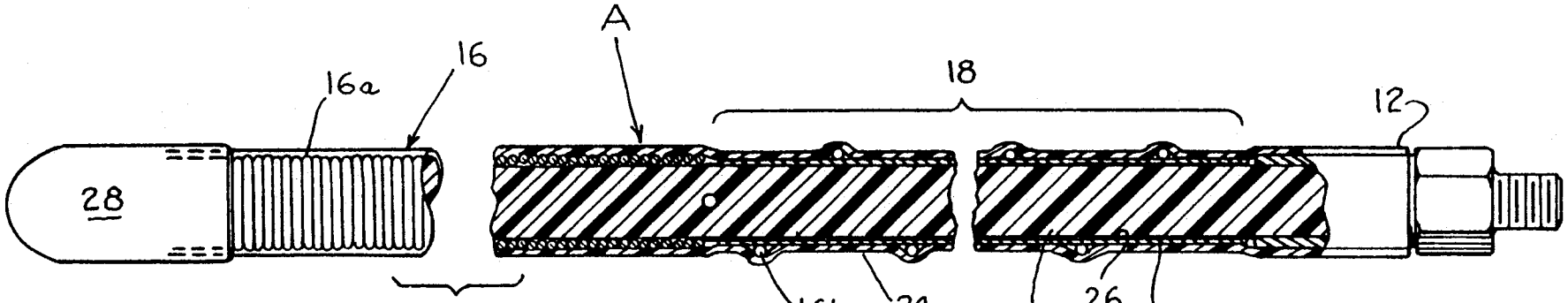
FIG. 3 is an elevation with parts cut away in section illustrating a decorative antenna according to the present invention and method.
Figure 4:
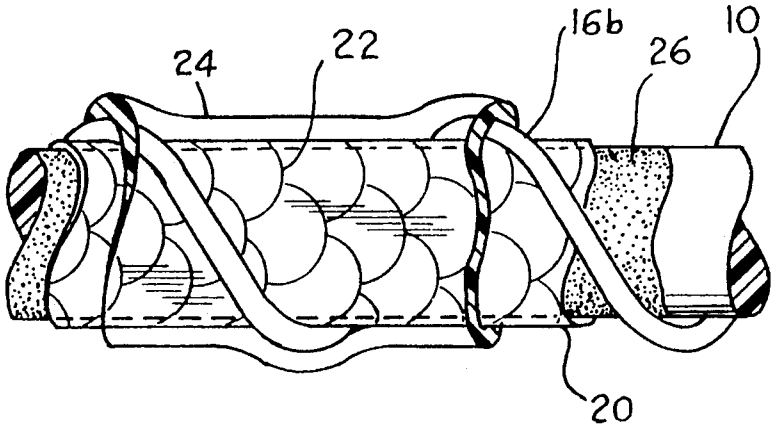
FIG. 4 is an enlarged partial elevation with parts cut away.

Referring now in more detail to the drawings, a decorative antenna, designated generally as A, is illustrated, which includes an elongated fiberglass core (10). Fiberglass is preferred because of flexibility. Other dielectric materials may also be used for the core. A first end 10*a* of core 10 includes an attachment ferrule 12 having exterior threads 14 which thread into an associated mounting bracket (not shown) affixed to a vehicle and the like. Ferrule 12 is suitably affixed directly to elongated core 10 by means of adhesive, etc. An opposite end, 10*b*, of core 10 includes a wire wrapped tuning coil 16 which is tuned to a desired frequency at which the antenna is to perform. In between ferrule 12 and coil 16 is an exposed portion 18 of the core. Surrounding at least this exposed portion is a layer 20 of a decorative, patterned, non-conductive film 20. Preferably, film 20 is a highly reflective film having a well defined pattern readily distinguishable from a single or solid color. For example, in the illustrated embodiment, there is a well defined fish scale pattern 22, that is highly reflective and visible. Tuning coil 16 includes closely adjacent windings 16*a*. Windings 16*b*, integral with winding 16*a*, are spaced apart and extend from the windings 16*a* to ferrule 12 and are soldered thereto. Of course, tuning coil 16 may be electrically connected to ferrule 12 by a straight wire (not shown) in lieu of spiral windings 16*b*. Alternately, a conductive foil may be used as a decorative fiber, and connected between the coil and ferrule, although the embodiment described above is preferred. Surrounding the coil windings, decorative film layer 20, and core 10 is a transparent shrink film 24. The shrink film protects the underneath structure while allowing the highly reflective and visible pattern of the antenna to be readily seen.

Film 20 may be any suitable reflective film such as a plasticized film manufactured by Spartan International, Inc., of Holt, Mich. Preferably, such a decorative film has an adhesive backing on a side opposite pattern side 22. While it is possible that the reflective film may extend underneath ferrule 12 and coil windings 16*a*, it is preferred that it doesn't so as to not to adversely affect the performance of the coil or the attachment of the ferrule to the core. Even plastic film may have sufficient conductance to effect coil 16. It is preferred that the ferrule be mechanically or adhesively attached directly to the core for reliability.

In accordance with the method, an elongated fiberglass core 10 is provided, a film substrate 20 and core 10 are laid upon a rubber table, whereupon the film substrate is rolled on the pole and adhered to by any suitable means such as an adhesive 26. With the film substrate adhered to the core, the core is next taken to a winding table where the conductive coil 16 is wound upon core 10. Next, or before coil 16 is wound, the ferrule 12 is attached and glued. The end of coil winding 16*b* is soldered to ferrule 12. Finally, the shrink film is applied and a tip 28 of the antenna is affixed over the antenna.

While a preferred embodiment of the invention has bee described using specific terms, such description is for illustrative purposes only, and it is to be understood that changes and variation may be made without departing from the spirit or scope of the following claims.

What is claimed is:

1. A decorative antenna having a highly visible and reflective pattern comprising:

an elongated dielectric core;

an attachment ferrule secured to one end of the core;

a tuning coil wound about a second end of said core;

a decorative film layer composed of a non-conductive material surrounding a circumference of said core and extending along at least a portion of the length of said core;

wherein said core and said decorative film are formed of different materials;

a conductive coil wrapped in spaced apart spirals around said decorative film layer; and a visually transparent film secured tightly over said spirals of said conductive coil and said decorative film layer so that said transparent film, spiral and decorative film layers provide a highly visible decorative antenna;

said decorative film includes a reflective, well defined pattern on an exterior of said decorative film which is highly visual through said transparent film; and including means for affixing said decorative film to said core.

2. The device of claim 1 wherein said means for affixing said decorative film to said core comprises an adhesive composition affixed to a back side of said decorative film.

3. The device of claim 1 including an adhesive layer disposed between at least a portion of said core and said decorative film.

4. The device of claim 1 wherein said decorative film terminates short of said tuning coil at said second end of said 5. The apparatus of the device of claim 4 wherein said decorative film terminates short of said attachment ferrule.

6. The device of claim 1 wherein said decorative film terminates short of said attachment ferrule.

7. The device of claim 1 wherein said decorative film includes a highly reflective plasticized film having non-conductive properties which minimize interference with the electrical characteristics of said antenna.

8. A decorative antenna having a highly visible and reflective pattern comprising:

an elongated non-plasticized dielectric core;

an attachment ferrule secured directly to one end of the core;

a tuning coil wound about a second end of said core;

said core having an exposed length extending from said attachment ferrule to said tuning coil;

a decorative plasticized film layer surrounding said exposed length of said core; wherein said decorative film terminates short of said tuning coil at said second end of said core, and terminates short of said attachment ferrule whereby said decorative film does not interfere with the performance of said tuning coil;

conductive means connecting said tuning coil and said ferrule; and a visually transparent film secured tightly over said decorative film layer.

9. The device of claim 8 including means for affixing said decorative film to said core.

10. The device of claim 8 wherein said decorative film includes a highly reflective plasticized film having a well defined pattern and non-conductive properties which minimize interference with the electrical characteristics of said antenna.

* * * * *